US009982387B2

(12) United States Patent
Noguchi et al.

(10) Patent No.: US 9,982,387 B2
(45) Date of Patent: May 29, 2018

(54) METHOD FOR PRODUCING FINE FIBERS AND SHEET CONTAINING FINE FIBERS

(71) Applicant: OJI HOLDINGS CORPORATION, Tokyo (JP)

(72) Inventors: Yuichi Noguchi, Tokyo (JP); Yasutomo Noishiki, Tokyo (JP); Takayuki Kishida, Tokyo (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 415 days.

(21) Appl. No.: 14/402,161

(22) PCT Filed: May 17, 2013

(86) PCT No.: PCT/JP2013/063770
§ 371 (c)(1),
(2) Date: Nov. 19, 2014

(87) PCT Pub. No.: WO2013/176049
PCT Pub. Date: Nov. 28, 2013

(65) Prior Publication Data

US 2015/0122430 A1 May 7, 2015

(30) Foreign Application Priority Data

May 21, 2012 (JP) ..... 2012-115474

(51) Int. Cl.

| | |
|---|---|
| ***D21C 9/00*** | (2006.01) |
| ***D21H 11/18*** | (2006.01) |
| ***D21H 13/30*** | (2006.01) |
| ***D21H 13/28*** | (2006.01) |
| ***D21H 15/02*** | (2006.01) |
| ***D21H 17/66*** | (2006.01) |
| *D21H 11/20* | (2006.01) |

(52) U.S. Cl.
CPC ..... *D21C 9/002* (2013.01); *D21C 9/007* (2013.01); *D21H 11/18* (2013.01); *D21H 13/28* (2013.01); *D21H 13/30* (2013.01); *D21H 15/02* (2013.01); *D21H 17/66* (2013.01); *D21H 11/20* (2013.01)

(58) Field of Classification Search
CPC ..... D21C 9/002; D21C 9/004; D21C 9/001; D21C 9/005; D21C 9/007
See application file for complete search history.

(56) References Cited

U.S. PATENT DOCUMENTS 5,454,907 A * 10/1995 Hayashi ..... C08B 37/003 162/26
5,779,736 A * 7/1998 Frederick ..... D06M 11/38 162/100
8,992,728 B2 3/2015 Isogai et al.
2011/0036523 A1* 2/2011 Harkonen ..... D21B 1/16 162/28
2012/0009661 A1* 1/2012 Miyawaki ..... C08B 15/02 435/277

FOREIGN PATENT DOCUMENTS

| | | | |
|---|---|---|---|
| CN | 101874043 | A | 10/2010 |
| CN | 102093484 | A | 6/2011 |
| CN | 102361915 | A | 2/2012 |
| JP | 2010-236106 | A | 10/2010 |
| JP | 2010-254726 | A | 11/2010 |
| WO | WO 2010/116795 | A1 | 10/2010 |

OTHER PUBLICATIONS

Wasshausen et al.,"Premix": A Novel process for improved bleaching of mechanical pulps using a mixture of reducing agents, 2006, Pulp and Paper Canada, 107:3, p. 44-47.*
Rapspon et al.,Carbonyl Groups in Cellulose and Colour Reversion, 1957 Pulp and Paper Magazine of Canada, p. 151-158.*
Lemeune et al.,Effects of Ozone and Chlorine Dioxide on the Chemical Properties of Cellulose Fibers, 2004,Journal of Applied Polymer Science, vol. 93, p. 1219-1223.*
Smook, Handbook for Pulp and Paper Technologists, 1992, Angus Wilde Publications, 2nd edition, chapter 13.*
Holik editor, Handbook of Pulp, 2014, Wiley-VCH, section 2.3.4.*
Jonobi et al., Preparation of cellulose nanofibers with hydrophobic surface characteristics, Apr. 2009, Cellulose, 17, 299-307.*
Chinese Office Action and Search Report dated Jun. 9, 2015, for Chinese Application No. 201380026687.X with the English translation.
Japanese Notice of Allowance dated Jun. 23, 2015, for Japanese Application No. 2013-527383.

* cited by examiner

*Primary Examiner* — Anthony Calandra
(74) *Attorney, Agent, or Firm* — Birch, Stewart, Kolasch & Birch, LLP

(57) ABSTRACT

The object of the present invention is to provide a method for producing fine fibers and a sheet containing fine fibers, whereby fiber refinement (fibrillating) of a fiber material is facilitated, freeness and dehydration performance of slurry containing fine fibers obtained after fiber refinement (fibrillating) is favorable and resistance to yellowing of the fine fibers is improved. The present invention provides a method for producing fine fibers, comprising at least the steps of: (a) introducing electrostatic and/or steric functional substituents into a fiber material to obtain substituent-introduced fibers; (b) subjecting the substituent-introduced fibers to mechanical treatment; and (c) eliminating some or all of introduced substituents from the substituent-introduced fine fibers obtained in step (b) to obtain fine fibers from which substituents have been eliminated.

14 Claims, No Drawings

METHOD FOR PRODUCING FINE FIBERS AND SHEET CONTAINING FINE FIBERS

TECHNICAL FIELD

The present invention relates to a method for producing fine fibers and a sheet containing fine fibers.

BACKGROUND ART

In recent years, in light of alternative oil resources and the growing environmental awareness, materials obtained from reproducible natural fibers have been getting attention. Among natural fibers, cellulose fibers having fiber diameters of 10-50 μm and especially cellulose fibers from wood (pulp) have been widely used until now for paper products. In addition, fine cellulose fibers having fiber diameters of 1 μm or less are also known as the cellulose fibers. A sheet containing such fine cellulose fibers is advantageous in that it has high mechanical strength and thus there have been attempts to use the sheet for various applications (Patent Literature 1). For example, it is known that nonwoven fabric obtained by papermaking of fine cellulose fibers is used as a high-strength sheet.

A method for producing fine fibers, which is often used in the art, comprises introducing electrostatic and/or steric functional substituents into a fiber material to facilitate fiber refinement (fibrillating) of the fiber material (e.g., Patent Literature 2 and 3). Patent Literature 2 and 3 disclose that hydrophilic carboxyl groups are introduced onto the cellulose surface such that repulsion between fibers is enhanced, thereby allowing fiber refinement (fibrillating) by mechanical treatment with relatively small energy. However, fine fibers into which such substituents have been introduced tend to experience temporal or thermal discoloration to yellow or brown (hereinafter collectively referred to as "yellowing"), and in the worst case, discoloration to dark brown or black, which has been problematic. In addition, when slurry is prepared using the fine fibers into which substituents have been introduced to produce a sheet by a paper making method or a coating method, freeness is poor, dehydration takes a long time, and productivity extremely decreases, which also has been problematic.

CITATION LIST

Patent Literature

Patent Literature 1: JP 2008-24788 A
Patent Literature 2: JP 2010-254726 A
Patent Literature 3: JP 2008-308802 A

SUMMARY OF INVENTION

Object to be Solved by the Invention

The object to be solved by the present invention is to provide a method for producing fine fibers and a sheet containing fine fibers by solving the above problems. Specifically, the object to be solved by the present invention is to provide a method for producing fine fibers and a sheet containing fine fibers, whereby fiber refinement (fibrillating) of a fiber material is facilitated, favorable freeness and dehydration performance of slurry containing fine fibers obtained after fiber refinement (fibrillating) can be achieved, and temporal or thermal yellowing of the obtained fine fibers and the sheet containing fine fibers can be improved.

Means for Solution of Object

The present invention provides the following (1) to (7).

(1) A method for producing fine fibers, comprising at least the steps of:

(a) introducing electrostatic and/or steric functional substituents into a fiber material to obtain substituent-introduced fibers;

(b) subjecting the substituent-introduced fibers to mechanical treatment; and (c) eliminating some or all of introduced substituents from the substituent-introduced fine fibers obtained in step (b) to obtain fine fibers from which substituents have been eliminated.

(2) The method for producing fine fibers according to (1), wherein the electrostatic and/or steric functional substituents are phosphoric acid-derived groups and/or carboxylic acid-derived groups.

(3) The method for producing fine fibers according to any one of (1) and (2), wherein the fine fibers have an average width of 2-1000 nm.

(4) The method for producing fine fibers according to any one of (1) to (3), wherein the fiber material comprises hydroxyl groups and/or amino groups.

(5) The method for producing fine fibers according to any one of (1) to (4), wherein the fiber material contains cellulose.

(6) The method for producing fine fibers according to any one of (1) to (5), wherein the fiber material contains chitin and/or chitosan.

(7) A method for producing a sheet containing fine fibers, comprising the steps of: preparing slurry containing the fine fibers produced by the method according to any one of (1) to (6); and obtaining a sheet by a paper making method or a coating method.

Advantageous Effects of Invention

According to the method for producing fine fibers of the present invention, sufficient fiber refinement (fibrillating) of a fiber material can be achieved, resulting in a high fine fiber yield. Therefore, the efficiency of production of fine fibers from a fiber material is high. Also, according to the method for producing a sheet containing fine fibers of the present invention, the efficiency of production of the sheet using a fiber material can be improved. Further, according to the production method of the present invention, temporal or thermal yellowing of the obtained fine fibers and the sheet containing the fine fibers can be prevented.

EMBODIMENTS FOR CARRYING OUT THE INVENTION

Steps of Producing Fine Fibers

The method for producing fine fibers of the present invention comprises at least the steps of:

(a) introducing electrostatic and/or steric functional substituents into a fiber material to obtain substituent-introduced fibers;

(b) subjecting the substituent-introduced fibers to mechanical treatment; and (c) eliminating some or all of introduced substituents from the substituent-introduced fine fibers obtained in step (b) to obtain substituent-eliminated fine fibers.

The above three steps are explained below in detail.

[Step (a)]

Step (a) of introducing electrostatic and/or steric functional substituents into a fiber material is not particularly limited. It is possible to introduce the substituents into a fiber material in a dried or wet state by mixing the fiber material with a compound that reacts with the fiber material. Heating is very effective for promoting the reaction upon introduction. The heating treatment temperature for substituent introduction is not particularly limited. It is preferably in a temperature range that is unlikely to cause thermal decomposition, hydrolysis, or the like of the fiber material. For example, if a fiber material containing cellulose is selected as the fiber material, the temperature for heating treatment is preferably 250° C. or less in terms of thermal decomposition temperature and 100° C. to 170° C. in terms of prevention of cellulose hydrolysis.

The fiber material used in the present invention is not particularly limited. Examples thereof include inorganic fibers, organic fibers, synthetic fibers, semisynthetic fibers, and recycled fibers. Examples of inorganic fibers include, but are not limited to, glass fibers, rock fibers, and metal fibers. Examples of organic fibers include, but are not limited to, fibers from natural products such as cellulose, carbon fibers, pulp, chitin, and chitosan. Examples of synthetic fibers include, but are not limited to, nylon, vinylon, vinylidene, polyester, polyolefin (e.g., polyethylene or polypropylene), polyurethane, acrylic, polyvinyl chloride, and aramid. Examples of semisynthetic fibers include, but are not limited to, acetate, triacetate, and promix. Examples of recycled fibers include, but are not limited to, rayon, cupra, polynosic rayon, lyocell, and tencel.

In addition, although the fiber material used in the present invention is not particularly limited, it preferably comprises hydroxyl groups or amino groups for the ease of substituent introduction described below.

The fiber material to be used is preferably, but not particularly limited to, pulp because pulp is readily available and inexpensive. Pulp used herein is selected from among wood pulp, non-wood pulp, and deinking pulp. Examples of wood pulp include, but are not particularly limited to: chemical pulp such as leaf bleached kraft pulp (LBKP), needle bleached kraft pulp (NBKP), sulfite pulp (SP), soda pulp (AP), unbleached kraft pulp (UKP), or oxygen-bleached kraft pulp (OKP); semi-chemical pulp (SCP) such as chemiground wood pulp (CGP); and mechanical pulp such as ground wood pulp (GP) or thermomechanical pulp/bleached chemi-thermomechanical pulp (TMP/BCTMP). Examples of non-wood pulp include, but are not particularly limited to: cotton-based pulp such as cotton linters and cotton lint; non-wood-based pulp such as hemp, straw, or bagasse; and cellulose, chitin, or chitosan isolated from sea squirts and seaweeds. Examples of deinking pulp include, but are not limited to, deinking pulp obtained from used paper as a raw material. One type of the examples may be used alone or a mixture of two or more types of the examples may be used as the pulp in the present invention. Among the examples of the pulp, wood pulp containing cellulose or deinking pulp is preferable because it is readily available. The wood pulp is particularly preferably, but not limited to, chemical pulp because chemical pulp has a high cellulose content, which results in a high yield of fine cellulose fibers upon fiber refinement (fibrillating), and the degree of cellulose degradation in pulp is low, which makes it possible to obtain fine cellulose fibers having long fiber lengths with a large axial ratio. The wood pulp to be selected is most preferably, but not limited to, kraft pulp or sulfite pulp. A sheet containing the fine cellulose fibers having long fiber lengths with a large axial ratio has high strength.

The compound that reacts with the fiber material is not particularly limited. Examples thereof include a compound having phosphoric acid-derived groups, a compound having carboxylic acid-derived groups, a compound having sulfuric acid-derived groups, a compound having sulfonic acid-derived groups, a compound having alkyl groups having 10 or more carbon atoms, and a compound having amine-derived groups. A compound having phosphoric acid-derived groups and/or carboxylic acid-derived groups is preferable in terms of the ease of handling and reactivity with fine fibers. It is more preferable that the compound forms an ester and/or amide with any of the fine fibers, but the present invention is not particularly limited thereto.

The compound having phosphoric acid-derived groups used in the present invention is not particularly limited. It is at least one member selected from a group consisting of phosphoric acid, polyphosphoric acid, phosphorous acid, phosphonic acid, polyphosphonic acid, and esters or salts thereof. Of these, the compound is preferably, but not particularly limited to, a compound having phosphoric acid groups because it can be obtained at low cost, and handled with ease, and the fiber refinement (fibrillating) efficiency can be further improved by introducing phosphoric acid groups into the fiber material.

Examples of the compound having phosphoric acid groups include, but are not particularly limited to: phosphoric acid; lithium salts of phosphoric acid such as lithium dihydrogen phosphate, dilithium hydrogen phosphate, trilithium phosphate, lithium pyrophosphate, and lithium polyphosphate; sodium salts of phosphoric acid such as sodium dihydrogen phosphate, disodium hydrogen phosphate, trisodium phosphate, sodium pyrophosphate, and sodium polyphosphate; potassium salts of phosphoric acid such as potassium dihydrogen phosphate, dipotassium hydrogen phosphate, tripotassium phosphate, potassium pyrophosphate, and potassium polyphosphate; and ammonium salts of phosphoric acid such as ammonium dihydrogen phosphate, diammonium hydrogen phosphate, triammonium phosphate, ammonium pyrophosphate, and ammonium polyphosphate.

The compound is not particularly limited to these examples. From the viewpoints of the high efficiency of introduction of phosphate groups and industrial applicability, phosphoric acid, a sodium salt of phosphoric acid, a potassium salt of phosphoric acid, and an ammonium salt of phosphoric acid are preferable, and sodium dihydrogen phosphate and disodium hydrogen phosphate are more preferable.

In addition, the compound is preferably used in the form of an aqueous solution in view of the reaction uniformity and high efficiency of introduction of phosphoric acid-derived groups; however, the form of the compound is not particularly limited. The pH of an aqueous solution of the compound is not particularly limited; it is preferably not more than 7 at which high efficiency of introduction of phosphoric acid groups can be achieved. For the purpose of preventing hydrolysis of fibers, the pH is particularly preferably, but not limited to, pH 3-7.

A compound having carboxylic acid-derived groups used in the present invention is not particularly limited; it is at least one member selected from the group consisting of compounds having carboxyl groups, acid anhydrides of compounds having carboxyl groups, and derivatives thereof.

Examples of compounds having carboxyl groups include, but are not particularly limited to: dicarboxylic acid compounds such as maleic acid, succinic acid, phthalic acid, fumaric acid, glutaric acid, adipic acid, and itaconic acid; and tricarboxylic acid compounds such as citric acid and aconitic acid.

Examples of acid anhydrides of compounds having carboxyl groups include, but are not particularly limited to, acid anhydrides of dicarboxylic acid compounds such as maleic anhydride, succinic anhydride, phthalic anhydride, glutaric anhydride, adipic anhydride, and itaconic anhydride.

Examples of derivatives of compounds having carboxyl groups include, but are not limited to, imidized acid anhydrides of compounds having carboxyl groups and derivatives of acid anhydrides of compounds having carboxyl groups. Examples of imidized acid anhydrides of compounds having carboxyl groups include, but are not limited to, imidized dicarboxylic acid compounds such as maleimide, succinic imide, and phthalic imide.

Examples of derivatives of acid anhydrides of compounds having carboxyl groups include, but are not limited to, acid anhydrides of compounds having carboxyl groups in which at least some hydrogen atoms are substituted with substituents (e.g., alkyl groups and phenyl groups) such as dimethylmaleic anhydride, diethylmaleic anhydride, and diphenylmaleic anhydride.

Among the above compounds having carboxylic acid-derived groups, the compound used herein is preferably, but not limited to, maleic anhydride, succinic anhydride, or phthalic anhydride in view of industrial applicability and the ease of gasification.

Dispersibility of fibers in a solution can be improved by introducing substituents into a fiber material in step (a) above, which allows the improvement of fibrillating efficiency.

The amount of introduced substituents in substituent-introduced fibers obtained in step (a) above is preferably, but not particularly limited to, $0.005\alpha$-$0.11\alpha$ per 1 g of fibers (by mass). It is more preferably $0.01\alpha$-$0.08\alpha$. When the amount of introduced substituents is less than $0.005\alpha$, fiber refinement (fibrillating) of a fiber material is difficult. When the amount of introduced substituents exceeds $0.11\alpha$, fibers might be dissolved. Note that a represents the amount of functional groups which can react with a compound that reacts with a fiber material (e.g., hydroxyl groups and amino groups) per 1 g of the fiber material (unit: mmol/g).

[Step (b)]

Step (b) is a step of subjecting substituent-introduced fibers obtained in step (a) to fiber refinement (fibrillating) treatment using a fibrillating treatment apparatus to obtain substituent-introduced fine fibers.

Examples of the fibrillating treatment apparatus that can be adequately used include, but are not particularly limited to, wet milling apparatuses such as a high-speed fibrillating machine, a grinder (a stone mill crusher), a high pressure homogenizer, an ultra high pressure homogenizer, Cleamix, a high pressure impact crusher, a ball mill, a bead mill, a disk refiner, a conical refiner, a biaxial kneader, a vibration mill, a high speed homomixer, an ultrasonic disperser, and a beater.

Fibrillating treatment is not particularly limited. It is preferable to dilute substituent-introduced fibers obtained in step (a) with water or an organic solvent alone or a combination thereof to obtain slurry upon fibrillating treatment. The solid content concentration of substituent-introduced fibers after dilution is preferably, but not particularly limited to, 0.1%-20% by mass. It is more preferably 0.5%-10% by mass. If the solid content concentration of the substituent-introduced fibers after dilution is not less than the lower limit, fibrillating treatment efficiency is improved. If it is not more than the upper limit, obstruction in the fibrillating treatment apparatus can be prevented. A dispersion medium is not particularly limited. A polar organic solvent as well as water can be used as a dispersion medium. Examples of preferred polar organic solvents include, but are not particularly limited to: alcohols such as methanol, ethanol, n-propanol, isopropanol, n-butanol, and t-butyl alcohol; ketones such as acetone and methyl ethyl ketone (MEK); ethers such as diethyl ether and tetrahydrofuran (THF); and dimethyl sulfoxide (DMSO); dimethylformamide (DMF); and dimethyl acetamide (DMAc). One example or two or more examples of the above may be used. Further, as long as dispersion stability of the slurry containing fine fibers is not undermined, a non-polar organic solvent may be used, in addition to the polar organic solvent and water described above.

The content of fine fibers in slurry containing fine fibers after fiber refinement (fibrillating) treatment is preferably, but not limited to, 0.02%-10% by mass. It is more preferably 0.1%-5% by mass. If the fine fiber content is not less than the lower limit, excellent production efficiency is achieved for sheet production described below. If it is not more than the upper limit, excellent slurry dispersion stability is achieved.

According to the present invention, the fiber width of substituent-introduced fine fibers obtained by fiber refinement (fibrillating) is not particularly limited; it is preferably 1-1000 nm, more preferably 2-500 nm, and further preferably 3-100 nm. When the fiber width of fine fibers is less than 1 nm, molecules are dissolved in water and therefore physical properties (strength, rigidity, and dimensional stability) of fine fibers are not exhibited. Meanwhile, when it exceeds 1000 nm, the obtained fibers cannot be regarded as fine fibers and therefore physical properties (strength, rigidity, and dimensional stability) of fine fibers cannot be obtained.

In applications that require fine fibers to have transparency, if the fiber width exceeds 30 nm, the wavelength of light that passes through fine fibers approaches 1/10 of the wavelength of visible light, and if a complex of fine fibers and a matrix material is formed, refraction and scattering of visible light at an interface therebetween tends to occur, resulting in a decrease in transparency. Therefore, although the fiber width is not particularly limited, it is preferably 2 nm-30 nm and more preferably 2-20 nm. In general, a complex obtained from such fine fibers is a fine construct having high strength. Such a complex is less likely to cause scattering of visible light and thus it has high transparency.

Measurement of the fiber width of fine fibers is performed in the following manner. Slurry containing fine fibers with a concentration of 0.05%-0.1% by mass is prepared and is cast into a hydrophilized carbon-film-coated grid. Thus, a TEM observation sample is obtained. When the slurry contains wide fibers, an SEM image of the surface of slurry cast on glass may be observed. The observation is performed based on an electron microscope image at a magnification of 1,000 times, 5,000 times, 10,000 times, 20,000 times, or 50,000 times in accordance with the width of the fibers constituting the slurry. The sample, observation conditions, and the magnification are adjusted to satisfy the following requirements.

(1) A straight line X is drawn arbitrarily in an observation image such that 20 or more fibers intersect the straight line X.

(2) A straight line Y that intersects perpendicularly with the straight line X is drawn in the same image such that 20 or more fibers intersect the straight line Y.

For the observation image that satisfies the above requirements, the width of the fibers intersecting the straight line X or Y are visually read. At least three sets of images of the surface portions that do not overlap each other are observed to read the width of fibers that intersect the straight line X or Y on each image as described above. The fiber width is read for at least 20×2×3=120 fibers. The fiber width of the present invention corresponds to the mean value of the fiber widths read in the above manner.

The fiber length of fine fibers is not particularly limited; it is preferably 0.1 μm or more. When the fiber length is less than 0.1 μm, it is difficult to obtain the effect of improving strength when a complex of fine fibers and a resin is formed. The fiber length can be obtained by TEM, SEM, or AFM image analysis. The fiber length accounts for 30% by mass of fine fibers.

The axis ratio of fine fibers (fiber length/fiber width) is not particularly limited; it is preferably in a range of 20-10000. When the axis ratio is less than 20, it might be difficult to form a sheet containing fine fibers. When the axis ratio exceeds 10000, the viscosity of slurry increases, which is unfavorable.

[Step (c)]

Step (c) is a step of eliminating some or all of substituents of substituent-introduced fine fibers obtained in step (b) to obtain substituent-eliminated fine fibers. A method for eliminating substituents is not particularly limited; it involves biological treatment such as heating hydrolysis treatment or enzyme treatment. Heating hydrolysis treatment is preferable for the convenience of treatment. The heating temperature is not particularly limited; it is preferably 50° C. or more and more preferably 90° C. or more. Note that a temperature that prevents decomposition of a fiber material is preferably selected as the heating temperature for substituent elimination. Although the temperature is not particularly limited, it is 250° C. or less and preferably 200° C. or less when, for example, cellulose is used as a fiber material. In addition, an additive such as acid or base may be adequately added upon heating.

The content of substituents in fine fibers after substituent elimination is not particularly limited; it is 70% or less, preferably 50% or less, and further preferably 30% or less with respect to the content upon introduction. When the content of substituents decreases, a time required for draining water to obtain a sheet containing fine fibers can be reduced, making it possible to prevent yellowing or the like when heating the sheet.

[Desalting Step]

According to the present invention, treatment steps that are performed after step (c) are not particularly limited. A desalting step is preferably included for the purpose of improving purity of fine fibers. Examples of a desalting step include, but are not particularly limited to, filtration washing, dialysis, and ion exchange. Ion exchange treatment is preferable for the convenience of treatment. The use of a strongly acidic ion exchange resin and a strongly basic ion exchange resin in combination or in an alternate manner is more preferable.

In addition to steps (a), (b), and (c) and the desalting step described above, a washing step or another treatment step may be optionally added between two consecutive steps, before step (a), or after the desalting step, if needed. A step to be added is not particularly limited. For example, a step of eliminating foreign matter may be added before step (b) or a purification step involving centrifugation or the like may be added after step (b); however, the step is not particularly limited.

(Redispersion Step)

According to the above method, the dispersibility of fine fibers in a solution after substituent elimination is improved compared with that of fine fibers before substituent introduction. When aggregation occurs, a redispersion step for allowing redispersion of fine fibers after substituent elimination may be added; however, it is not particularly limited. An example of a method for redispersion of fine fibers is a method for adding a component such as a surfactant or an organic solvent to a dispersion medium (an aqueous solution or an organic solvent) containing fine fibers. However, the method to be used is not particularly limited as long as dispersibility of fine fibers is improved. In the redispersion step, it is also possible to stir a dispersion medium containing fine fibers. Stirring conditions are not particularly limited as long as dispersibility of fine fibers is improved.

<Sheet Production>

A sheet can be produced using substituent-eliminated fine fibers obtained in the above manner. A sheet production method is not particularly limited; a paper making method, a coating method, and the like are preferably used. A complex containing fine fibers can be formed by impregnating an obtained sheet with a resin.

The sheet of the present invention is not particularly limited; it can be prepared by mixing the fine fibers and at least one type of fibers other than the fine fibers (hereinafter referred to as "additional fibers"). Examples of additional fibers include, but are not particularly limited to, inorganic fibers, organic fibers, synthetic fibers, semisynthetic fibers, and recycled fibers. Examples of inorganic fibers include, but are not limited to, glass fibers, rock fibers, and metal fibers. Examples of organic fibers include, but are not limited to, fibers from natural products such as cellulose, carbon fibers, pulp, chitin, and chitosan. Examples of synthetic fibers include, but are not limited to, nylon, vinylon, vinylidene, polyester, polyolefin (e.g., polyethylene or polypropylene), polyurethane, acrylic, polyvinyl chloride, and aramid. Examples of semisynthetic fibers include, but are not limited to, acetate, triacetate, and promix. Examples of recycled fibers include, but are not limited to, rayon, cupra, polynosic rayon, lyocell, and tencel. The additional fibers may be subjected to treatment such as chemical treatment or fibrillating treatment, if needed. When additional fibers are subjected to treatment such as chemical treatment or fibrillating treatment, they may be mixed with fine fibers and then subjected to treatment such as chemical treatment or fibrillating treatment. Alternatively, additional fibers may be subjected to treatment such as chemical treatment or fibrillating treatment and then mixed with fine fibers. When additional fibers are mixed with fine fibers, the amount of additional fibers to be added with respect to the total amount of fine fibers and additional fibers is not particularly limited; it is preferably 50% by mass or less, more preferably 40% by mass or less, and further preferably 30% by mass or less. It is particularly preferably 20% by mass or less.

[Paper Making Method]

It is possible to perform paper making using slurry containing substituent-eliminated fine fibers by means of a continuous paper making machine such as a fourdrinier type, cylinder type or tilted type paper making machine used for conventional paper making, a multilayer paper making machine comprising a combination of continuous paper making machines, or a conventional paper making method such as hand paper making, so that a sheet is formed as in the case of conventional paper. That is, slurry containing fine fibers is subjected to wire filtration and dehydration to obtain a wet paper sheet, followed by pressing and drying. Thus, a sheet can be obtained. The slurry concentration is not particularly limited; it is preferably 0.05%-5% by mass. If the concentration is excessively low, filtration takes a very long time. On the other hand, if the concentration is excessively high, a uniform sheet cannot be obtained, which is unfavorable. Upon filtration and dehydration of slurry, filter fabric for filtration is not particularly limited. It is important that fine fibers do not pass through filter fabric and the filtration speed is not excessively slow. Such filter fabric is not particularly limited; it is preferably a sheet comprising organic polymers, woven fabric, or porous membrane. Preferable examples of organic polymer include, but are not particularly limited to, non-cellulose organic polymers such as polyethylene terephthalate, polyethylene, polypropylene, and polytetrafluoroethylene (PTFE). Specific examples thereof include, but are not particularly limited to, a porous membrane comprising polytetrafluoroethylene with a pore size of 0.1-20 μm, e.g., 1 μm and woven fabric made of polyethylene terephthalate or polyethylene with a pore size of 0.1-20 μm, e.g., 1 μm.

A method for producing a sheet from slurry containing fine fibers is not particularly limited. An example of the method is the method disclosed in WO2011/013567 which comprises using a production apparatus comprising: a dewatering section for ejecting slurry containing fine cellulose fibers on the upper surface of an endless belt and dewatering a dispersion medium contained in the ejected slurry to form a web; and a drying section for drying the web to produce a fiber sheet, wherein the endless belt is continuously provided to the dewatering section and the drying section, and the web formed in the dewatering section is transferred to the drying section while being placed on the endless belt.

A dehydration method that can be used in the present invention is not particularly limited. An example of the method is a dehydration method conventionally used for paper production. A preferable example is a method comprising performing dehydration using fourdrinier, cylinder, or tilted wire, etc. and then further performing dehydration using a roll press. In addition, a drying method is not particularly limited. An example thereof is a method used for paper production. For example, a method using a cylinder dryer, a yankee dryer, hot air drying, or an infrared heater is preferable.

The sheet containing fine fibers is allowed to have a different porosity depending on the production method. A method for producing a sheet having a large porosity is not particularly limited. An example thereof is a method comprising a film-forming step by filtration which involves substitution of water contained in a sheet with an organic solvent such as alcohol. That is, water is removed by filtration and an organic solvent such as alcohol is added when the fine fiber content reaches 5%-99% by mass. Alternatively, water contained in a sheet may be substituted by introducing slurry containing fine fibers into a filtration apparatus and then providing an organic solvent such as alcohol to the top surface of slurry. When a complex is obtained by impregnating a sheet containing fine fibers with polymers, the sheet is less likely to be impregnated with polymers if porosity is small. Therefore, the porosity is preferably, but not limited to, for example, 10% by volume or more and more preferably 20% by volume or more. Examples of organic solvents such as alcohol to be used herein include, but are not limited to: glycol ethers such as dipropylene glycol methyl ether, ethylene glycol monobutyl ether, and diethylene glycol monoethyl ether; glymes such as diethylene glycol dimethyl ether, diethylene glycol dibutyl ether, tetraethylene glycol dimethyl ether, triethylene glycol dimethyl ether, diethylene glycol diethyl ether, ethylene glycol diethyl ether, ethylene glycol dimethyl ether, and diethylene glycol isopropylmethyl ether; dihydric alcohols such as 1,2-butanediol and 1,6-hexanediol; diethylene glycol monoethyl ether acetate; and ethylene glycol monomethyl ether acetate. Two or more types of these organic solvents can be used in combination. When a non-water-soluble organic solvent is used as the organic solvent, it is preferable to use a mixed solvent of a non-water-soluble organic solvent and a water-soluble organic solvent or to substitute water with a water-soluble organic solvent and then substitute the water-soluble organic solvent with a non-water-soluble organic solvent.

[Coating Method]

A coating method used herein is a method wherein a base material is coated with slurry containing substituent-eliminated fine fibers, the coating is dried, and a fine fiber-containing layer that has been formed is peeled off from the base material, thereby obtaining a sheet. The sheet can be continuously produced with the use of a coating apparatus and an elongated base material. Property of a base material is not particularly limited. If it has high wettability with respect to slurry containing fine fibers, sheet contraction upon drying or the like can be preferably prevented. Meanwhile, it is preferable to select a base material so that a sheet formed thereon can be easily peeled off after drying. In particular, a base material is preferably, but not particularly limited to, a resin plate or a metal plate. It is preferable to select an appropriate base material from the examples described herein and use the base material alone or in a laminate form. Examples of a base material that can be used include, but are not particularly limited to: resin plates such as an acrylic plate, a polyethylene terephthalate plate, a vinyl chloride plate, a polystyrene plate, and a polyvinylidene chloride plate; metal plates such as an aluminum plate, a zinc plate, a copper plate, and an iron plate; plates obtained by acid treatment of the surfaces of the resin or metal plates; stainless-steel plates; and brass plates. In order to coat a base material with slurry containing fine fibers, a variety of coaters that can coat the base material with a predetermined amount of slurry can be used. Examples of coaters that can be used include, but are not particularly limited to, roll coaters, gravure coaters, die coaters, curtain coaters, spray coaters, blade coaters, rod coaters, and air doctor coaters. Of these, coating by a die coater, a curtain coater, a spray coater, an air doctor coater, or the like is effective for uniform coating. In addition, drying is not particularly limited; hot air drying, infrared drying, vacuum drying, or the like is effective. An elongated rolled base material is subjected to coater coating and drying to obtain a sheet, thereby enabling continuous sheet production. A sheet formed on a base material may be rolled up with the base material and the sheet may be peeled-off from the base material when used. Alternatively, the sheet may be peeled off before rolling up the base material, that is to say, the base material and the sheet may be separately rolled up.

The thickness of the sheet containing fine fibers is not particularly limited; it is preferably 1 μm or more and more preferably 5 μm or more. In addition, it is conventionally 1000 μm or less and preferably 5-250 μm.

According to the present invention, after substituent-introduced fine fibers produced in the above step is formed into a sheet, substituents introduced into fine fibers contained in this sheet can be eliminated. The method for eliminating substituents is not particularly limited.

<Actions and Effects>

As a result of introduction of electrostatic and/or steric functional substituents into fine fibers, electrostatic repulsion between fine fibers is induced, thereby facilitating fiber refinement (fibrillating) of fine fibers. However, the presence of substituents causes a problem of temporal or thermal yellowing of fibers. In addition, since fine fibers have good water retention, in order to obtain an aggregate containing fine fibers (e.g., a sheet containing fine fibers) by dehydration or drying of slurry containing fine fibers, there is a problem of poor dehydration or drying efficiency.

Fine fibers obtained by temporarily introducing electrostatic and/or steric functional substituents, performing fiber refinement (fibrillating), and eliminating some or all of the substituents have significantly improved properties against temporal yellowing and thermal yellowing. In addition, dehydration of slurry containing fine fibers is excellent. Thus, a sheet containing fine fibers can be easily obtained.

EXAMPLES

The present invention is more specifically explained below with reference to the Examples and the Comparative Examples; however, the present invention is not limited thereto. In addition, the units "part" and "%" in the Examples and Comparative Examples denote "part by mass" and "% by mass," respectively, unless otherwise specified.

Example 1

<Introduction of Substituents into a Fiber Material>

Sodium dihydrogen phosphate dehydrate (66.43 g) and disodium hydrogen phosphate (49.47 g) were dissolved in water (135.50 g) and thus an aqueous solution of a phosphoric acid compound (hereinafter referred to as "phosphorylation reagent A") was obtained. The pH of the phosphorylation reagent A was 6.0 at 25° C.

A sample of leaf bleached kraft pulp (Oji Paper Co., Ltd.; moisture: 80%; Canadian Standard Freeness (CSF) measured according to JIS P8121: 560 ml) was collected (absolute dry mass: 120 g). The phosphorylation reagent A (251.40 g) was added (20 parts by mass of elemental phosphorus with respect to 100 parts by mass of dried pulp). The mixture was kneaded once every 15 minutes at 105° C. using an air dryer (Yamato Scientific Co., Ltd. DKM400) and dried until a constant mass was obtained. Then, heating treatment was performed at 150° C. for 1 hour using the air dryer. Thus, substituent (phosphoric acid group)-introduced cellulose fibers were obtained.

Next, a sample of the phosphoric acid group-introduced cellulose fibers (3 g) was collected and ion-exchange water (300 ml) was added, followed by washing with stirring and dehydration. The dehydrated pulp was diluted with ion-exchange water (300 ml). A 1N sodium hydroxide aqueous solution (5 ml) was added little by little with stirring. Thus, slurry containing cellulose fibers with pH 12-13 was obtained. Then, the slurry was dehydrated and ion-exchange water (300 ml) was added. Dehydration and washing were performed again. Then, dehydration and washing were repeated once more.

<Fiber Refinement of a Fiber Material>

Ion-exchange water was added to cellulose fibers obtained after dehydration and washing to prepare slurry (0.5% by mass). The slurry was subjected to fibrillating treatment using a fibrillating treatment apparatus (M Technique Co., Ltd., Cleamix-2.2S) at 21500 revolutions/minute for 30 minutes. Ion-exchange water was added to adjust the slurry solid content concentration to 0.2% by mass. The slurry was centrifuged using a high-speed cooling centrifuge (KOKUSAN Co., Ltd., H-2000B) at 12000 G×10 minutes. The resulting supernatant was collected. Thus, slurry containing fine cellulose fibers was obtained.

<Elimination of Substituents from a Fine Fiber Material>

A sample of the obtained slurry containing fine cellulose fibers (300 mL) was introduced into an SUS304 pressure-proof container and subjected to heating hydrolysis treatment in an autoclave at 120° C. for 2 hours. Then, desalting was performed by the method described below ([Treatment of slurry containing fine cellulose fibers with an ion exchange resin]) to obtain substituent-eliminated fine cellulose fibers. The amount of substituents in the obtained slurry containing substituent-eliminated fine cellulose fibers was measured according to the method described below ([Measurement of the amount of substituents on the cellulose surface]). In addition, the average width of substituent-eliminated fine cellulose fibers was 2-1000 nm.

Example 2

Slurry containing substituent-eliminated fine cellulose fibers was obtained in the manner described in Example 1 except that the time for heating by an autoclave was set to 4 hours. The amount of substituents in the obtained slurry containing substituent-eliminated fine cellulose fibers was measured according to the method described below ([Measurement of the amount of substituents on the cellulose surface]). In addition, the average width of substituent-eliminated fine cellulose fibers was 2-1000 nm.

Example 3

<Introduction of Substituents into a Fiber Material>

A sample of needle bleached kraft pulp (Oji Paper Co., Ltd.; moisture: 80%; Canadian Standard Freeness (CSF) measured according to JIS P8121: 708 ml) was collected (absolute dry mass: 120 g). The phosphorylation reagent A (251.40 g) (20 parts by mass of elemental phosphorus with respect to 100 parts by mass of dried pulp) was added. The mixture was introduced into a container of a biaxial kneader equipped with a steam-heating jacket container. Steam was introduced into the jacket with mixing, followed by drying until the solid content reached 99%. The obtained dried product was subjected to heating treatment at 150° C. for 1 hour using an air dryer. Thus, phosphoric acid group-introduced cellulose fibers were obtained.

Next, a sample of the substituent (phosphoric acid group)-introduced cellulose fibers (3 g) was collected. Ion-exchange water (300 ml) was added, followed by washing with stirring and dehydration. The dehydrated cellulose fibers were diluted with ion-exchange water (300 ml). A 1N sodium hydroxide aqueous solution (5 ml) was added little by little with stirring to obtain slurry containing cellulose fibers with pH of 12-13. Then, the slurry was dehydrated and ion-exchange water (300 ml) was added. Dehydration and washing were performed again. Then, dehydration and washing were repeated once more.

<Fiber Refinement of a Fiber Material>

Ion-exchange water was added to cellulose fibers obtained after washing and dehydration, followed by stirring. Thus, slurry (0.5% by mass) was obtained. The pulp slurry was subjected to fibrillating treatment using a fibrillating treatment apparatus (M Technique Co., Ltd., Cleamix-2.2S) at 21500 revolutions/minute for 30 minutes. Then, ion-exchange water was added to adjust the slurry solid content concentration to 0.2% by mass. The slurry was centrifuged using a high-speed cooling centrifuge (KOKUSAN Co., Ltd., H-2000B) at 1000 G×10 minutes. The resulting supernatant was collected. Thus, slurry containing fine cellulose fibers was obtained.

<Elimination of Substituents from a Fine Fiber Material>

A sample of the obtained slurry containing fine cellulose fibers (1000 ml) was introduced into an SUS304 pressure-proof container. Heating hydrolysis treatment was performed using an oil bath provided with a magnetic stirrer at 160° C. for 2 hours to cause aggregation. Then, the aggregate was received on a mesh with an aperture of 250 μm. Ion-exchange water was poured onto the slurry, followed by washing. A homodisper was used at 8000 rpm×3 minutes for redispersion. Thus, slurry containing substituent-eliminated fine cellulose fibers was obtained.

The amount of substituents in the obtained slurry containing substituent-eliminated fine cellulose fibers was measured according to the method described below ([Measurement of the amount of substituents on the cellulose surface]). In addition, the average width of substituent-eliminated fine cellulose fibers was 2-1000 nm.

Example 4

<Introduction of Substituents into a Fiber Material>

Leaf bleached kraft pulp (LBKP) was dried at 105° C. for 3 hours to obtain dried pulp with a moisture of 3% by mass or less. Then, a maleic anhydride/acetone solution obtained by dissolving maleic anhydride (2 g) in acetone (4 g) was added dropwise to the dried pulp (4 g), followed by mixing. Thus, the dried pulp was allowed to absorb the maleic anhydride/acetone solution. The resulting pulp was dried at 40° C. for 30 minutes to evaporate acetone. An autoclave was filled with the pulp, placed in an oven, and treated at 150° C. for 2 hours.

Next, the dried pulp was dispersed in a sodium hydroxide aqueous solution (0.8% by mass, 250 mL) The resulting slurry was stirred for alkaline treatment of the pulp. The pH of the pulp slurry was about 12.5. Thereafter, the pulp subjected to alkaline treatment was washed with water until the pH reached 8 or less. Thus, substituent (maleic acid group)-introduced cellulose fibers were obtained.

<Fiber Refinement of a Fiber Material>

Ion-exchange water was added to the obtained maleic acid group-introduced cellulose fibers. Thus, slurry (solid content concentration: 0.5% by mass) was prepared. The slurry was subjected to fibrillating treatment using a fibrillating treatment apparatus (M Technique Co., Ltd., Cleamix-2.2S) at 21500 revolutions/minute for 30 minutes. The slurry was centrifuged using a high-speed cooling centrifuge (KOKUSAN Co., Ltd., H-2000B) at 12000 G×10 minutes. The resulting supernatant was collected. Thus, slurry containing fine cellulose fibers was obtained.

<Elimination of Substituents from a Fine Fiber Material>

A sample of the obtained slurry containing fine cellulose fibers (300 ml) was introduced into an SUS304 pressure-proof container and subjected to heating hydrolysis treatment in an autoclave at 120° C. for 4 hours. Then, desalting was performed by the method described below ([Treatment of slurry containing fine cellulose fibers with an ion exchange resin]) to obtain substituent-eliminated fine cellulose fibers.

The amount of substituents in the obtained slurry containing substituent-eliminated fine cellulose fibers was measured according to the method described below ([Measurement of the amount of substituents on the cellulose surface]). In addition, the average width of substituent-eliminated fine cellulose fibers was 2-1000 nm.

Comparative Example 1

Slurry containing fine cellulose fibers was obtained in the manner described in Example 1 except that the heating step using an autoclave was omitted.

The amount of substituents in the obtained slurry containing fine cellulose fibers was measured according to the method described below ([Measurement of the amount of substituents on the cellulose surface]).

Comparative Example 2

Slurry containing fine cellulose fibers was obtained in the manner described in Example 4 except that the heating step using an autoclave was omitted.

The amount of substituents in the obtained slurry containing fine cellulose fibers was measured according to the method described below ([Measurement of the amount of substituents on the cellulose surface]).

<Evaluation>

The amount of substituents in slurry containing fine cellulose fibers was measured according to the method described below ([Measurement of the amount of substituents on the cellulose surface]) for slurry containing fine cellulose fibers obtained in Examples 1-4 and Comparative Example 1-2. Table 1 lists the measurement results.

[Measurement of the Amount of Substituents on the Cellulose Surface]

A sample of slurry containing fine cellulose fibers with a solid content of about 0.04 g (absolute dry mass) was collected and diluted with ion-exchange water to result in an amount of about 50 g. The change of the value of electrical conductivity was determined when adding a 0.01N sodium hydroxide aqueous solution to the obtained solution with stirring by a magnetic stirrer. The amount of the 0.01N sodium hydroxide aqueous solution added dropwise when the minimum value of electrical conductivity was obtained was designated as the amount of the aqueous solution added dropwise at the titration end point.

Here, the amount of substituents on the cellulose surface X is expressed by X (mmol/g)=0.01 (mol/l)×V (ml)/W (g) where V denotes the amount of the 0.01N sodium hydroxide aqueous solution added dropwise (ml), and W denotes the solid content in slurry containing fine cellulose fibers (g).

[Treatment of Slurry Containing Fine Cellulose Fibers Using an Ion Exchange Resin]

For treatment of slurry containing fine cellulose fibers with the use of an ion exchange resin, an ion exchange resin was added to slurry containing fine cellulose fibers at a volume ratio of 1 to 10 (1/10), followed by shaking treatment for 1 hour. Then, treatment for separating the resin and slurry was performed three times by pouring the obtained mixture of the resin and slurry onto a mesh with an aperture of 90 μm. For the first treatment, a conditioned strongly acidic ion exchange resin (e.g., Amberjet 1024, Organo Corporation) was used. For the second treatment, a conditioned strongly basic ion exchange resin (e.g., Amberjet 4400, Organo Corporation) was used. The third treatment was performed as in the case of the first treatment.

TABLE 1

| | Substituent type | Substituent amount [mmol/g] |
|---|---|---|
| Example 1 | Phosphoric acid-derived substituent | 0.256 |
| Example 2 | Phosphoric acid-derived substituent | 0.116 |
| Example 3 | Phosphoric acid-derived substituent | 0.0086 |
| Example 4 | Maleic acid-derived substituent | 0.0478 |
| Comparative Example 1 | Phosphoric acid-derived substituent | 0.556 |
| Comparative Example 2 | Maleic acid-derived substituent | 0.571 |

A large amount of substituents were eliminated in Example 1-4 in which heating hydrolysis treatment was performed.

Example 5

Ion-exchange water was added to slurry containing substituent-eliminated fine cellulose fibers obtained in Example 1, and reduced pressure filtration of the slurry diluted to a concentration of 0.1% (168 g) was performed. KG-90 (Advantech Co., Ltd.) was used as a filter. A PTFE membrane filter (pore size: 1.0 μm; Advantech Co., Ltd.) was placed on a glass filter. The effective filtration area was 48 $cm^2$. Reduced pressure filtration was performed at a reduced pressure of −0.09 MPa (absolute degree of vacuum: 10 kPa). As a result, a cellulose fiber sediment was obtained on the PTFE membrane filter. This cellulose sediment was press dried using a cylinder dryer heated to 120° C. at a pressure of 0.15 MPa for 10 minutes to obtain a sheet.

Example 6

A sheet was obtained in the manner described in Example 5 except that slurry containing substituent-eliminated fine cellulose fibers obtained in Example 2 was used.

Example 7

A sheet was obtained in the manner described in Example 5 except that slurry containing substituent-eliminated fine cellulose fibers obtained in Example 4 was used.

Comparative Example 3

A sheet was obtained in the manner described in Example 5 except that slurry containing fine cellulose fibers obtained in Comparative Example 1 was used.

Comparative Example 4

A sheet was obtained in the manner described in Example 5 except that slurry containing fine cellulose fibers obtained in Comparative Example 2 was used.

<Evaluation>

For slurry containing fine cellulose fibers obtained in Examples 5-7 and Comparative Examples 3-4, the filtration time required for obtaining a cellulose sediment was measured. In addition, the degree of yellowing of a sheet was determined by the method described below. Table 2 summarizes the measurement results. Also, total light transmittance of the sheet was measured. Table 2 lists the results.

[Total Light Transmittance]

Total light transmittance was measured according to JIS K7136 using a Haze Meter (HM-150, Murakami Color Research Laboratory).

[Degree of Yellowing]

Each obtained sheet was heated in vacuo at 200° C. for 4 hours. Then, the E313 yellow index was determined according to ASTM standards using a portable spectrophotometer (Spectro Eye, GretagMacbeth). A smaller value means a smaller degree of yellowing.

TABLE 2

| | Substituent-introduced cellulose fiber | Filtration time [min] | Total light transmittance [%] | Degree of yellowing |
|---|---|---|---|---|
| Example 5 | Example 1 | 120 | 89.6 | 70.5 |
| Example 6 | Example 2 | 98 | 88.3 | 38.8 |
| Example 7 | Example 4 | 58 | 88.1 | 8.4 |
| Comparative Example 3 | Comparative Example 1 | 240 | 89.6 | Black discoloration |
| Comparative Example 4 | Comparative Example 2 | 200 | 87.6 | 19.2 |

In Examples 5-7 in which slurry containing substituent-eliminated fine cellulose fibers was used, the filtration time required for cellulose sediment formation was shorter than that for Comparative Examples 3-4 in which slurry containing fine cellulose fibers from which substituents had not been eliminated was used. The degree of yellowing of the sheet after heating decreased in Examples 5-7.

Example 8

Ion-exchange water was added to the desalted supernatant obtained in Example 3 so as to result in a concentration of 0.1%. Then, a sample of the resulting solution (168 g) was collected and subjected to reduced pressure filtration. KG-90 (Advantech Co., Ltd.) was used as a filter. A PTFE membrane filter (pore size: 1.0 μm; Advantech Co., Ltd.) was placed on a glass filter. The effective filtration area was 48 $cm^2$. Reduced pressure filtration was performed at a reduced pressure of −0.09 MPa (absolute degree of vacuum: 10 kPa). As a result, a cellulose fiber sediment was obtained on the PTFE membrane filter. Ethylene glycol mono t-butylether (3.76 ml) was poured to the cellulose sediment. Reduced pressure filtration was performed again to obtain a sediment. The sediment was press dried in a cylinder dryer heated to 120° C. at a pressure of 0.15 MPa for 5 minutes and further dried using an air dryer at 130° C. for 2 minutes to obtain a porous sheet.

Comparative Example 5

A porous sheet was obtained in the manner described in Example 8 using slurry which had not been subjected to the steps subsequent to the step of heating hydrolysis treatment in an oil bath in Example 3.

<Evaluation>

For the porous sheets obtained in Example 8 and Comparative Example 5, the filtration time required for obtaining a cellulose sediment was measured. In addition, the degree of yellowing of a porous sheet was determined by the method described below. Table 3 summarizes the measurement results. Also, total light transmittance of a porous sheet subjected to paraffin impregnation was measured. Table 3 lists the results.

[Total Light Transmittance (Paraffin Impregnation)]

Each porous sheet was impregnated with liquid paraffin under reduced pressure. Thereafter, total light transmittance was measured according to JIS K7136 using a Haze Meter (HM-150, Murakami Color Research Laboratory).

[Degree of Yellowing]

Each obtained sheet was heated in vacuo at 200° C. for 4 hours. Then, the E313 yellow index was determined according to ASTM standards using a portable spectrophotometer (Spectro Eye, GretagMacbeth). A smaller value means a smaller degree of yellowing.

TABLE 3

| | Substituent-introduced cellulose fiber | Filtration time (water) [min] | Filtration time (solvent) [min] | Total light transmittance [%] | Degree of yellowing |
|---|---|---|---|---|---|
| Example 8 | Example 3 | 61 | 52 | 95.7 | 10.0 |
| Comparative Example 5 | — | 207 | 110 | 97.5 | 14.0 |

In Example 8 in which slurry containing substituent-eliminated fine cellulose fibers was used, the filtration time required for cellulose sediment formation was shorter than that for Comparative Example 5 in which slurry containing fine cellulose fibers from which substituents had not been eliminated. The degree of yellowing of the obtained sheet after heating decreased in Example 8.

The present application claims priority from Japanese Patent Application No. 2012-115474, the content of which is hereby incorporated by reference into this application.

The invention claimed is:

1. A method for producing fine fibers, comprising at least the steps of:

(a) introducing electrostatic functional substituents into a fiber material having hydroxyl groups and/or amino groups, via an ester bond and/or an amide bond, to obtain substituent-introduced fibers;

(b) subjecting the substituent-introduced fibers to mechanical treatment; and (c) eliminating some or all of introduced substituents from the substituent-introduced fine fibers obtained in step (b) to obtain fine fibers from which substituents have been eliminated.

2. The method for producing fine fibers according to claim 1, wherein the electrostatic functional substituents are phosphoric acid-derived groups and/or carboxylic acid-derived groups.

3. The method for producing fine fibers according to claim 1, wherein the fine fibers have an average width of 2-1000 nm.

4. The method for producing fine fibers according to claim 1, wherein the fiber material contains cellulose.

5. The method for producing fine fibers according to claim 1, wherein the fiber material contains chitin and/or chitosan.

6. A method for producing a sheet containing fine fibers, comprising the steps of: producing fine fibers according to the method of claim 1, preparing slurry containing the fine fibers; and obtaining a sheet by a paper making method or a coating method.

7. The method for producing fine fibers according to claim 2, wherein the fine fibers have an average width of 2-1000 nm.

8. The method for producing fine fibers according to claim 2, wherein the fiber material contains cellulose.

9. The method for producing fine fibers according to claim 3, wherein the fiber material contains cellulose.

10. The method for producing fine fibers according to claim 2, wherein the fiber material contains chitin and/or chitosan.

11. The method for producing fine fibers according to claim 3, wherein the fiber material contains chitin and/or chitosan.

12. The method for producing fine fibers according to claim 4, wherein the fiber material contains chitin and/or chitosan.

13. A method for producing a sheet containing fine fibers, comprising the steps of: producing fine fibers according to the method of claim 2, preparing slurry containing the fine fibers; and obtaining a sheet by a paper making method or a coating method.

14. A method for producing a sheet containing fine fibers, comprising the steps of: producing fine fibers according to the method of claim 3, preparing slurry containing the fine fibers; and obtaining a sheet by a paper making method or a coating method.

* * * * *